US008157191B1

(12) United States Patent
vonBampus

(10) Patent No.: US 8,157,191 B1
(45) Date of Patent: Apr. 17, 2012

(54) NOZZLE FOR DRYWALL MUD SPRAY GUN

(76) Inventor: Ray vonBampus, Orlando, FL (US)

( * ) Notice: Subject to any disclaimer, the term of this patent is extended or adjusted under 35 U.S.C. 154(b) by 471 days.

(21) Appl. No.: 12/211,911

(22) Filed: Sep. 17, 2008

Related U.S. Application Data

(60) Provisional application No. 60/972,825, filed on Sep. 17, 2007.

(51) Int. Cl.

| | |
|---|---|
| ***B05B 1/28*** | (2006.01) |
| ***B05B 7/06*** | (2006.01) |
| ***F23D 11/10*** | (2006.01) |
| ***F23D 14/62*** | (2006.01) |
| ***F23D 11/16*** | (2006.01) |

(52) U.S. Cl. ..... 239/419.3; 239/296; 239/418; 239/419; 239/422; 239/427; 239/428; 239/543

(58) Field of Classification Search ..... 239/296, 239/298, 299, 398, 418, 419, 419.3, 421, 239/422, 427, 428, 428.5, 429, 430, 433, 239/543, 544, 553, 553.3, 553.5, 565
See application file for complete search history.

(56) References Cited

U.S. PATENT DOCUMENTS

| | | | | |
|---|---|---|---|---|
| 4,797,087 | A * | 1/1989 | Gitman | 431/10 |
| 5,944,507 | A * | 8/1999 | Feldermann | 431/189 |
| 6,001,177 | A * | 12/1999 | Gendreau et al. | 118/300 |
| 6,161,778 | A * | 12/2000 | Haruch | 239/290 |
| 2007/0194146 | A1 * | 8/2007 | Dorendorf | 239/419.3 |

* cited by examiner

*Primary Examiner* — Len Tran
*Assistant Examiner* — Ryan Reis
(74) *Attorney, Agent, or Firm* — Allen, Dyer, Doppelt, Milbrath & Gilchrist, P.A.

(57) ABSTRACT

A drywall mud spray nozzle includes a main inlet, a main outlet, a main bore extending between the main inlet and main outlet, a plurality of air injector bores having inlets adjacent the main inlet, outlets in the main bore, and outlets adjacent the main outlet, and a nozzle cap having a bore receiving outflow from the main outlet and air injector outlets and a nozzle tip through which the outflow sprays.

26 Claims, 5 Drawing Sheets

NOZZLE FOR DRYWALL MUD SPRAY GUN

RELATED APPLICATION

This application claims priority from provisional application Ser. No. 60/972,825 which was filed on 17 Sep. 2007, and which is incorporated herein by reference in its entirety.

FIELD OF THE INVENTION

The present invention relates to the field of gypsum drywall and, more particularly, to nozzle useful in a drywall mud spray gun for finishing a drywall installation.

BACKGROUND OF THE INVENTION

Gypsum drywalls, also known as wallboards, or just boards, are formed by sandwiching a core of wet gypsum plaster between two sheets of heavy paper. After the plaster core dries and sets, the sandwich becomes a rigid, very strong, and naturally fire-resistant building material. Gypsum in its natural state contains water, which releases steam when exposed to a fire's heat. Because the conversion of the water to steam consumes heat energy, heat transfer from the fire is retarded. Specific fire retardant compositions may also be added to the gypsum plaster to make drywall having yet a greater fire resistance. Gypsum drywall is an important building material throughout the world.

In building a structure, gypsum drywall is nailed to underlying supports to form the walls and other surfaces of the structure. Once nailed in place, the seams or joints between adjacent boards must be filled-in with drywall joint compound, also known in the art as "mud." Once the mud is applied to the joint, the joint must be covered with a strip of heavy paper, which is then overcoated with additional mud in order to smooth out the appearance of the wall. Conventionally finished joints do not provide the same degree of fire retardancy as the drywall itself. Thus, in a structure fire the joints will pop their seams before the drywall itself is affected by the heat.

Additionally, finishing the drywall installation is a time-consuming, manual process which delays the completion of the structure, as paint cannot be applied to the walls until after the drywall joints are filled and they dry and set. Also, as there occurs much waste of mud during the finishing process, the waste which usually falls on the floor, must be cleaned up before the finishing touches in the building process can be completed, for example, installing flooring such as wall to wall carpeting. The cleanup also consumes time and personnel, making it a significant cost to the builder.

SUMMARY OF THE INVENTION

With the foregoing in mind, the present invention advantageously provides a nozzle for a spray gun which handles viscous fluids such as drywall mud.

One preferred embodiment of the present nozzle comprises a main body having a main bore extending from a main inlet to a main outlet. The main inlet forms a connector nipple associated with a main inlet mechanical connector. The main outlet is also associated with a main outlet mechanical connector. A first plurality of air injector bores has inlets adjacent said main inlet, and outlets opening into the main bore between the main inlet and a midpoint along the main bore. A second plurality of air injector bores has inlets adjacent said main inlet, and outlets opening into the main bore between a midpoint along the main bore and the main outlet. A third plurality of air injector bores has inlets adjacent said main inlet, outlets adjacent said main outlet, and extends along said body generally parallel to said main bore. The nozzle includes a cap having a mechanical connector complementary to said main outlet mechanical connector. The cap has a cap bore providing a cap inlet dimensioned for receiving fluid from said main outlet and the outlets of said first, second and third pluralities of air injector bores, and has a cap outlet which forms the tip of said nozzle.

Another embodiment of the present nozzle for a drywall mud spray gun comprises a main inlet nipple having a threaded connector. The nozzle has a main outlet having a threaded connector. A drywall mud bore extends from the inlet nipple to the outlet. A first plurality of air injector bores has inlets adjacent the main inlet nipple and outlets adjacent the main outlet. A second plurality of air injector bores has inlets adjacent the main inlet nipple and outlets opening into the drywall mud bore upstream from a midpoint. A third plurality of air injector bores has inlets adjacent the main inlet nipple and outlets opening into the drywall mud bore downstream from a midpoint. A cap has a threaded connector complementary to the main outlet threaded connector, has a cap bore dimensioned for receiving outflow from the main outlet and first, second and third pluralities of air injector outlets and has a cap nozzle tip which directs the outflow into a stream of atomized drywall mud.

Yet another preferred embodiment of the invention includes a drywall mud spray nozzle comprising a main inlet, a main outlet, a main bore extending between the main inlet and main outlet, a plurality of air injector bores having inlets adjacent the main inlet, outlets in the main bore, and outlets adjacent the main outlet, and a nozzle cap having a bore receiving outflow from the main outlet and air injector outlets and a nozzle tip through which the outflow sprays.

BRIEF DESCRIPTION OF THE DRAWINGS

Some of the features, advantages, and benefits of the present invention having been stated, others will become apparent as the description proceeds when taken in conjunction with the accompanying drawings, presented solely for exemplary purposes and not with intent to limit the invention thereto, and in which.

DETAILED DESCRIPTION OF THE PREFERRED EMBODIMENT

Figure 1:
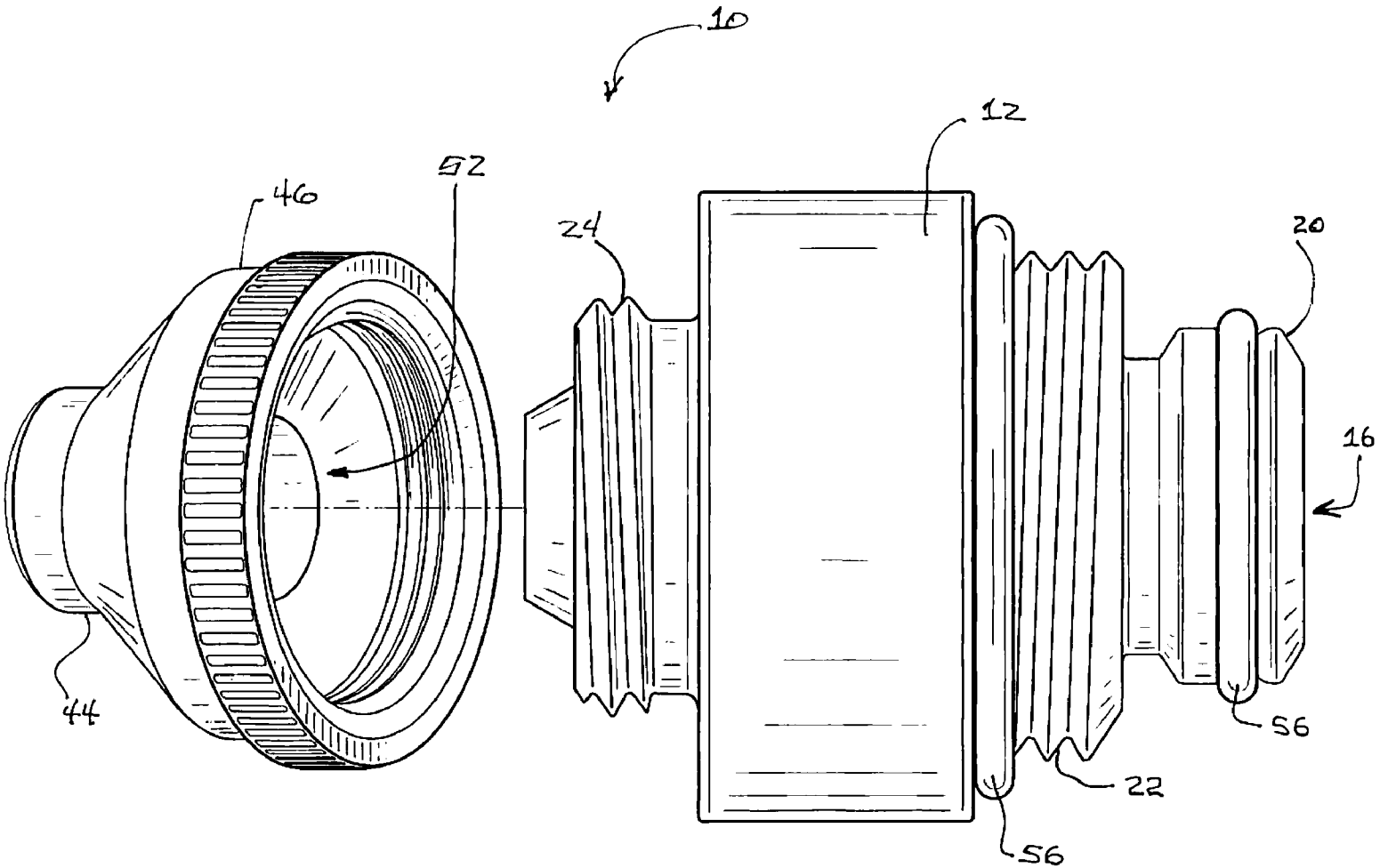
FIG. 1 is a side view of the nozzle, including the main body and the cap, according to an embodiment of the present invention.
Figure 2:
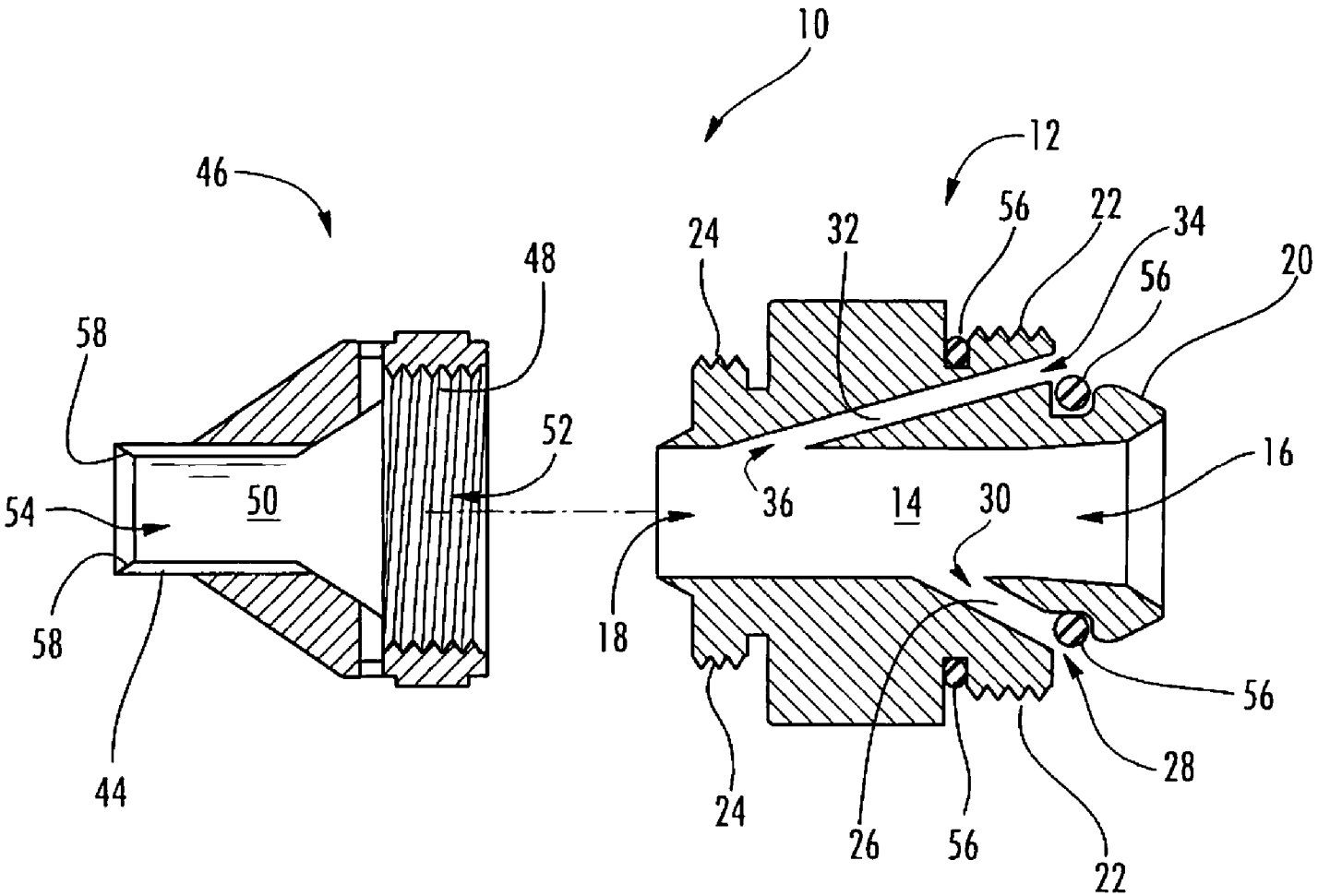
FIG. 2 shows a longitudinal cross section of the nozzle of FIG. 1.
Figure 3:
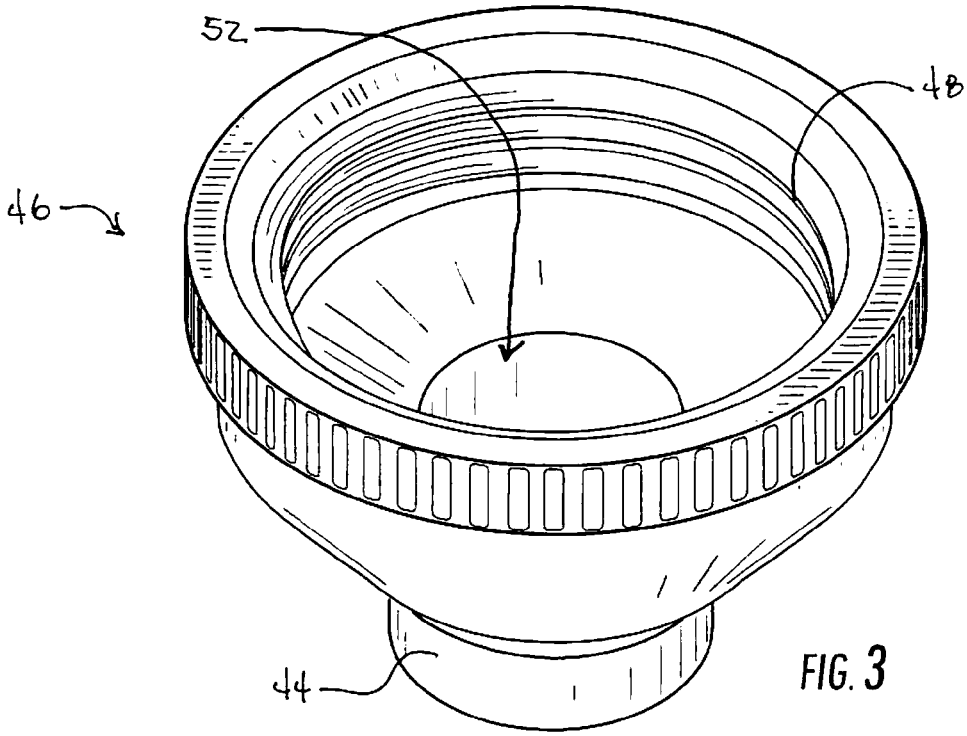
FIG. 3 is a bottom perspective view of the nozzle cap of FIG. 1.
Figure 4:
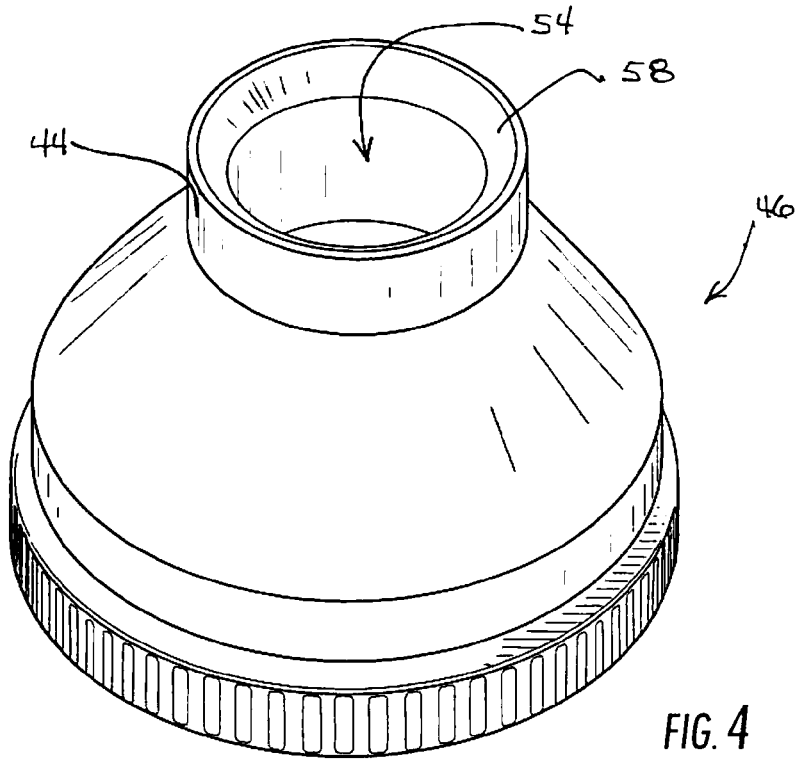
FIG. 4 is a top perspective view of the nozzle cap of FIG. 3.
Figure 5:
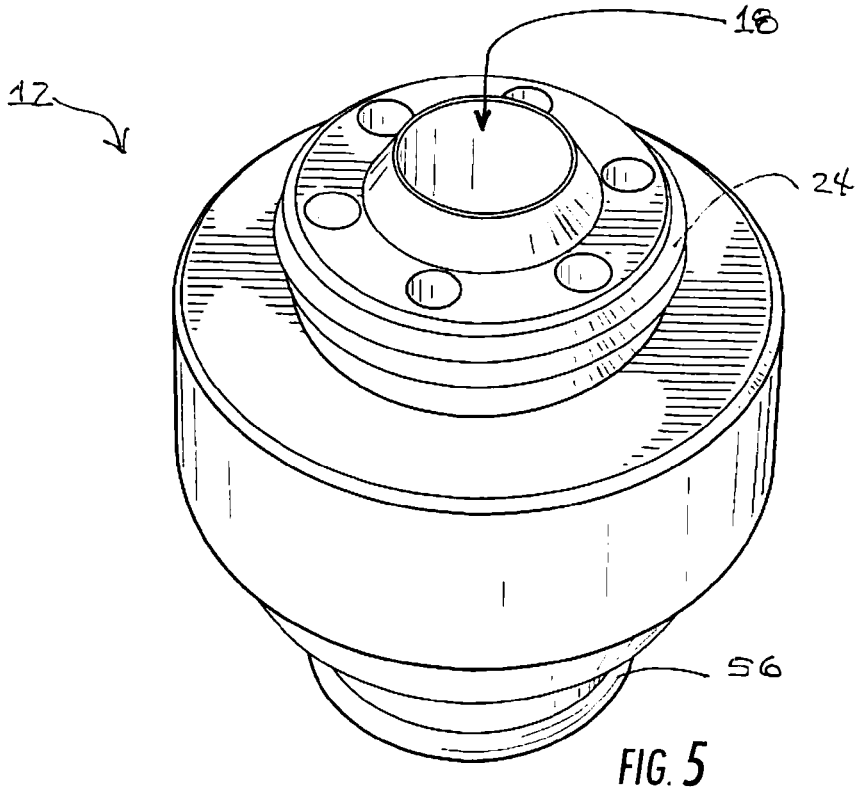
FIG. 5 shows a top perspective view of the nozzle main body seen in FIG. 1.
Figure 6:
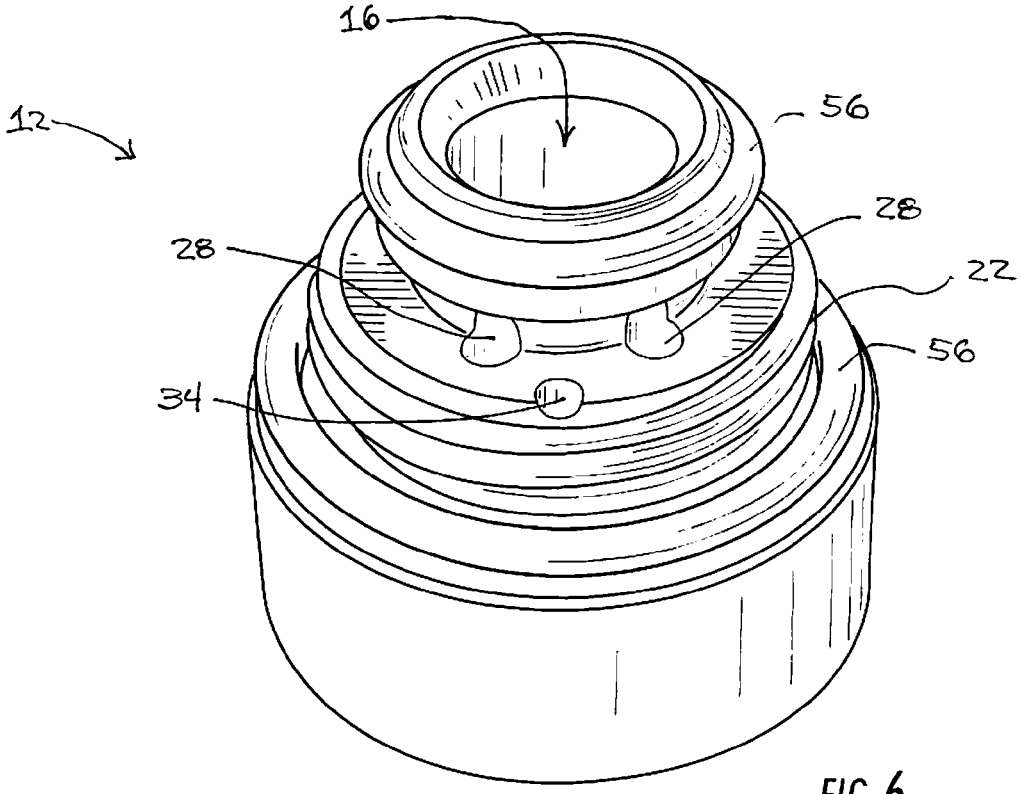
FIG. 6 provides a bottom perspective view of the nozzle of FIG. 5.
Figure 7:
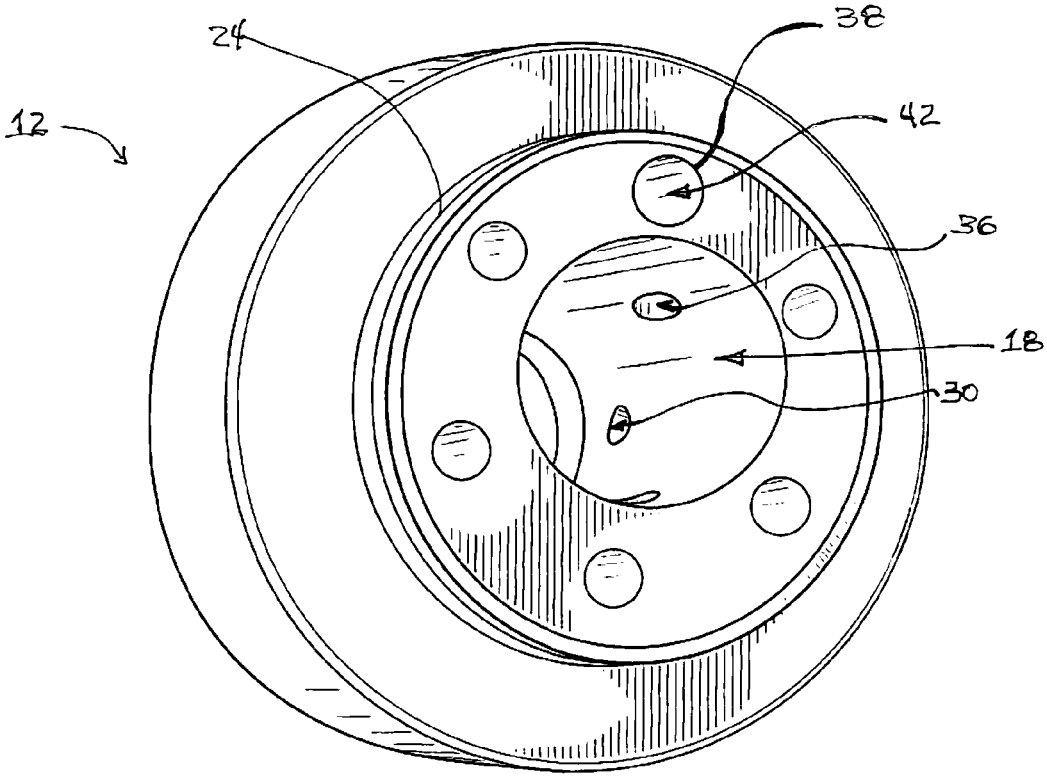
FIG. 7 depicts a top perspective view of the nozzle main body of FIG. 5, providing a view into the main bore and air injector bore openings therein.

The present invention will now be described more fully hereinafter with reference to the accompanying drawings, in which preferred embodiments of the invention are shown. Unless otherwise defined, technical and scientific terms used herein have the same meaning as commonly understood by one of ordinary skill in the art to which this invention pertains. Although methods and materials similar or equivalent to those described herein can be used in the practice or testing of the present invention, suitable methods and materials are described below. Any publications, patent applications, patents, and other references mentioned herein are incorporated by reference in their entirety. In case of conflict, the present specification, including any definitions, will control. In addition, the materials, methods and examples given are illustrative in nature only and not intended to be limiting. Accordingly, this invention may be embodied in many different forms and should not be construed as limited to the illustrated embodiments set forth herein. Rather, these illustrated embodiments are provided solely for exemplary purposes so that this disclosure will be thorough and complete, and will fully convey the scope of the invention to those skilled in the art. Other features and advantages of the invention will be apparent from the following detailed description, and from the claims.

The figures illustrate a nozzle 10 for a viscous fluids spray gun, for example, a drywall mud spray gun. A preferred drywall mud spray gun and system for use with the present nozzle 10 are disclosed in U.S. Pat. No. 6,912,824 (the '824 patent), which is incorporated herein by reference in its entirety.

The present nozzle 10 includes a main body 12 having a main bore 14 extending from a main inlet 16 to a main outlet 18. The main inlet 16 forms a connector nipple 20 associated with a main inlet mechanical connector 22 and the main outlet 18 is associated with a main outlet mechanical connector. The main inlet 16, main bore 14 and main outlet 18 provide a conduit for the drywall mud, which is pumped through the spray gun under pressure provided by a pump connected in the system, as shown in the '824 patent.

The nozzle 10 has a first plurality of air injector bores 26 having inlets 28 adjacent said main inlet 16, and outlets 30 opening into the main bore 14 between the main inlet and a midpoint along the main bore 14. The nozzle 10 also has a second plurality of air injector bores 32 having inlets adjacent said main inlet 16, and outlets opening into the main bore 14 between a midpoint along the main bore 14 and the main outlet 18. The nozzle 10 additionally has a third plurality of air injector bores 38 having inlets 40 adjacent said main inlet 16, outlets adjacent said main outlet 18, and extending along said body generally parallel to said main bore 14.

All the air injectors receive air under pressure from a system air pump and serve to both help atomize the drywall mud into small particles and to spray a stream of atomized drywall mud from the nozzle tip. The first plurality of air injector bores 26 has outlets 30 which discharge air under pressure into the first half of the main bore 14 conduit. The second plurality of air injector bores 32 has outlets which discharge air under pressure into the second half of the main bore 14 conduit, nearer the nozzle tip. These two groups of air injector bores run from the inlets to the outlets at an angle relative to the main bore 14. Accordingly, air is discharged from the air injector outlets 30, 36 into the main bore 14 at an angle which aids movement of the mud towards the nozzle tip.

The first plurality of air injector bores 26 preferably, but not exclusively, includes at least three bores having their outlets 30 arranged around the inner circumference of the main bore 14 to discharge into the main bore at approximately equidistant points upstream of a midpoint of the main bore. The air discharge promotes the relatively even movement of the mud within the main bore 14 towards the nozzle tip.

The second plurality of air injector bores 32 again preferably, but not exclusively, is similarly arranged, including at least three bores having their outlets disposed around the inner circumference of the main bore 14 to discharge into the main bore at approximately equidistant points downstream from a midpoint of the main bore. As before, the discharge of air into the main bore 14 promotes the relatively even progression of the mud towards the nozzle tip.

The nozzle 10 includes a cap 46 which has a mechanical connector 48 complementary to said main outlet's mechanical connector 24. The cap 46 has a cap bore 50 providing a cap inlet 52 dimensioned for receiving fluid from said main outlet 18 and from the outlets 30, 36, 42 of said first, second and third pluralities of air injector bores 26, 32. The cap outlet 54 forms the tip of said nozzle 10.

Additional structural features of the present nozzle 10 include the following. Those of skill in the art will readily understand that in preferred embodiments of the nozzle 10 the main bore 14 comprises a cylindrical conduit. Moreover, the main inlet 16 may comprise a bevel so that the inlet opening is larger than a diameter of the main bore 14. In the nozzle 10, the main inlet 16 and main outlet 18 associated mechanical connectors 22, 24 preferably comprise pressure couplings or, most preferably comprise threaded connectors. In the nozzle 10, each mechanical connector is associated with a seal 56 and most preferably with an O-ring seal.

As noted above, the first and second pluralities of air injector bores 26, 32 extend relative to the main bore 14 at different angles relative to the drywall mud bore from the inlets toward the outlets 30, 36. Preferably, the first plurality of air injector bores 26 extends from the inlets 28 to the outlets 30 at an larger angle relative to the main bore 14 than the second plurality of air injector bores 32. The second plurality of air injector bores 32 extends from the inlets to the outlets 36 at a larger angle relative to the main bore 14 than the first plurality of air injector bores 26. The first, second and third pluralities of air injector bores 26, 32, 38 preferably comprise cylindrical bores, although other cross-sectional profiles will function in the invention and are included herein.

In a most preferred embodiment of the nozzle 10, the third plurality of air injectors comprises six air injector bores 38 having their outlets 42 positioned around a periphery of said main outlet 18.

The nozzle cap outlet 54 is associated with a bevel 58 in the cap bore 50, so as to shape a stream discharged by said nozzle tip 44. Optionally, the cap nozzle tip 44 may comprise a beveled interior diameter.

Accordingly, in the drawings and specification there have been disclosed typical preferred embodiments of the invention and although specific terms may have been employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. A nozzle for a viscous fluids spray gun, said nozzle comprising:

a main body having a main bore extending from a main inlet to a main outlet, the main inlet forming a connector nipple associated with a main inlet mechanical connector and the main outlet is associated with a main outlet mechanical connector;

a first plurality of air injector bores having inlets adjacent said main inlet, and outlets opening into the main bore between the main inlet and a midpoint along the main bore;

a second plurality of air injector bores having inlets adjacent said main inlet, and outlets opening into the main bore between a midpoint along the main bore and the main outlet;

a third plurality of air injector bores having inlets adjacent said main inlet, outlets adjacent said main outlet, and extending along said body generally parallel to said main bore; and a cap having a mechanical connector complementary to said main outlet mechanical connector, having a cap bore providing a cap inlet dimensioned for receiving fluid from said main outlet and the outlets of said first, second and third pluralities of air injector bores, and having a cap outlet forming the tip of said nozzle.

2. The nozzle of claim 1, wherein the main bore comprises a cylindrical conduit.

3. The nozzle of claim 1, wherein the main inlet comprises a bevel so that the inlet opening is larger than a diameter of the main bore.

4. The nozzle of claim 1, wherein the main inlet and main outlet associated mechanical connectors comprise pressure couplings.

5. The nozzle of claim 1, wherein the main inlet and main outlet associated mechanical connectors comprise threads.

6. The nozzle of claim 1, wherein the first and second pluralities of air injector bores extend at different angles relative to the drywall mud bore from the inlets toward the outlets.

7. The nozzle of claim 1, wherein the first plurality of air injector bores extends from the inlets to the outlets at an larger angle relative to the main bore than the second plurality of air injector bores.

8. The nozzle of claim 1, wherein the second plurality of air injector bores extends from the inlets to the outlets at a larger angle relative to the main bore than the first plurality of air injector bores.

9. The nozzle of claim 1, wherein the first, second and third pluralities of air injector bores comprise cylindrical bores.

10. The nozzle of claim 1, wherein said third plurality comprises six air injector bores having their outlets positioned around a periphery of said main outlet.

11. The nozzle of claim 1, wherein each mechanical connector is associated with a seal.

12. The nozzle of claim 1, wherein each mechanical connector is associated with an O-ring seal.

13. The nozzle of claim 1, wherein the cap outlet is associated with a bevel in the cap bore, said bevel effective for shaping a stream discharged by said nozzle tip.

14. The nozzle of claim 1, wherein the cap nozzle tip comprises a nozzle tip outlet having a beveled interior diameter.

15. A nozzle for a drywall mud spray gun, said nozzle comprising:

a main inlet nipple having a threaded connector;

a main outlet having a threaded connector;

a drywall mud bore extending from the inlet nipple to the outlet;

a first plurality of air injector bores having inlets adjacent the main inlet nipple and outlets adjacent the main outlet;

a second plurality of air injector bores having inlets adjacent the main inlet nipple and outlets opening into the drywall mud bore upstream from a midpoint;

a third plurality of air injector bores having inlets adjacent the main inlet nipple and outlets opening into the drywall mud bore downstream from a midpoint; and a cap having a threaded connector complementary to the main outlet threaded connector, having a cap bore with a cap inlet dimensioned for receiving outflow from the main outlet and first, second and third pluralities of air injector outlets and having a cap outlet at the nozzle tip directing the outflow into a stream of atomized drywall mud.

16. The nozzle of claim 15, wherein the drywall mud bore comprises a cylindrical conduit.

17. The nozzle of claim 15, wherein the main inlet comprises a bevel so that the inlet opening is larger than a diameter of the drywall mud bore.

18. The nozzle of claim 15, wherein the first and second pluralities of air injector bores extend at different angles from the inlets toward the outlets.

19. The nozzle of claim 15, wherein the first plurality of air injector bores extends from the inlets to the outlets at an larger angle relative to the drywall mud bore than the second plurality of air injector bores.

20. The nozzle of claim 15, wherein the second plurality of air injector bores extends from the inlets to the outlets at an larger angle relative to the drywall mud bore than the first plurality of air injector bores.

21. The nozzle of claim 15, wherein the first, second and third pluralities of air injector bores comprise cylindrical bores.

22. The nozzle of claim 15, wherein said third plurality comprises six air injector bores having their outlets positioned around a periphery of said main outlet.

23. The nozzle of claim 15, wherein each threaded connector is associated with a seal.

24. The nozzle of claim 15, wherein each threaded connector is associated with an O-ring seal.

25. The nozzle of claim 15, wherein the cap nozzle tip outlet is associated with a bevel in the cap bore, said bevel effective for shaping a stream discharged by said nozzle tip.

26. The nozzle of claim 15, wherein the cap comprises a beveled interior diameter at the nozzle tip outlet.

* * * * *